US009353962B2

(12) United States Patent
Lowe et al.

(10) Patent No.: US 9,353,962 B2
(45) Date of Patent: May 31, 2016

(54) ROOF VENT

(75) Inventors: Steven E. Lowe, South Bend, IN (US); Mark J. Keller, Mishawaka, IN (US)

(73) Assignee: Cor-A-Vent, Inc., Mishawaka, IN (US)

( * ) Notice: Subject to any disclaimer, the term of this patent is extended or adjusted under 35 U.S.C. 154(b) by 1241 days.

(21) Appl. No.: 12/653,231

(22) Filed: Dec. 10, 2009

(65) Prior Publication Data

US 2010/0144266 A1 Jun. 10, 2010

Related U.S. Application Data

(60) Provisional application No. 61/201,442, filed on Dec. 10, 2008.

(51) Int. Cl.
*F24F 7/02* (2006.01)
*E04D 13/17* (2006.01)

(52) U.S. Cl.
CPC ..... *F24F 7/02* (2013.01); *E04D 13/176* (2013.01)

(58) Field of Classification Search
CPC ... E04D 13/174; E04D 13/176; E04D 13/178; F24F 7/02; F24F 13/28
USPC ..... 454/365, 364, 207, 366, 158, 111; 52/198, 199, 302.1
See application file for complete search history.

(56) References Cited

U.S. PATENT DOCUMENTS

| | | | | |
|---|---|---|---|---|
| 2,518,550 | A | | 8/1950 | Ives |
| 3,146,932 | A | | 9/1964 | Mayer |
| 3,949,657 | A | | 4/1976 | Sells |
| 4,286,006 | A | | 8/1981 | Boelter |
| 4,507,348 | A | | 3/1985 | Nagata et al. |
| 4,924,761 | A | | 5/1990 | MacLeod et al. |
| 5,009,149 | A | | 4/1991 | MacLeod et al. |
| 5,054,254 | A | | 10/1991 | Sells |
| 5,060,431 | A | | 10/1991 | MacLeod et al. |
| 5,174,076 | A | | 12/1992 | Schiedegger et al. |
| 5,425,672 | A | | 6/1995 | Rotter |
| 5,458,538 | A | * | 10/1995 | MacLeod et al. ..... 454/365 |
| 5,542,882 | A | * | 8/1996 | Sells ..... 454/365 |
| 5,651,734 | A | | 7/1997 | Morris |
| 5,673,521 | A | | 10/1997 | Coulton et al. |
| 5,713,158 | A | * | 2/1998 | Gibbs ..... 52/57 |
| 6,039,646 | A | * | 3/2000 | Sells ..... 454/365 |

(Continued)

FOREIGN PATENT DOCUMENTS

| | | | |
|---|---|---|---|
| DE | 4204374 | A1 | 8/1993 |
| EP | 0 613 997 | A1 | 9/1994 |
| EP | 0 791 699 | A1 | 2/1997 |

(Continued)

OTHER PUBLICATIONS http://www.mongooseproductsinc.com/installation.html.

*Primary Examiner* — Avinash Savani
*Assistant Examiner* — Vivek Shirsat
(74) *Attorney, Agent, or Firm* — Faegre Baker Daniels LLP

(57) ABSTRACT

A roof vent used to cover a vent opening in the ridge of a roof that includes a base portion configured to extend generally longitudinally along the ridge of a roof; a plurality of vent extension members extending down from the base portion, the vent extension members forming vent passages to vent air exiting the vent opening and direct the air beneath and out of the sides of the vent, the vent extension members set at an angle to the longitudinal direction of the vent; and generally V-shaped filter members attached to said vent with the small end of the V adjacent said base portion.

16 Claims, 11 Drawing Sheets

(56) References Cited

U.S. PATENT DOCUMENTS

| | | | | |
|---|---|---|---|---|
| 6,260,315 | B1 | 7/2001 | Smith | |
| 6,491,581 | B1 * | 12/2002 | Mankowski | 454/365 |
| 7,024,828 | B2 | 4/2006 | Headrick | |
| 7,814,715 | B2 * | 10/2010 | Coulton et al. | 52/198 |
| 2005/0069693 | A1 * | 3/2005 | Hofmann | 428/317.7 |
| 2005/0229503 | A1 * | 10/2005 | Rotter | 52/95 |

FOREIGN PATENT DOCUMENTS

| | | | |
|---|---|---|---|
| JP | 406277527 | A | 10/1994 |
| JP | 407308586 | A | 11/1995 |
| JP | 407308587 | A | 11/1998 |

* cited by examiner

ROOF VENT

This application claims the benefit of U.S. Provisional Patent Application Ser. No. 61/201,442 filed Dec. 10, 2008, the complete disclosure of which is hereby expressly incorporated by reference.

BACKGROUND OF THE INVENTION

This invention relates to a vent suitable for use on the ridge of a roof, and in particular, one embodiment relates to a molded vent that can be provided in a rolled form.

It is desirable that the attic or upper story of a building or structure be vented to atmosphere to prevent heat buildup within a structure. A ventilating cap can be provided that includes vent parts or spacers that are applied on either side of the ridge, and may be covered with shingles or other roof covering material.

Furthermore, ventilating material must be carried to the roof for installation over the vent opening. One manner to package a vent product for shipping and for ease of use in carrying the vent on a roof is to manufacture the vent from a light-weight material and provide it in a rolled form.

The roll may be secured with a fastener to prevent it from unrolling prematurely. After the vent roll is transported to the roof of the structure, the fastener can be released, and the material rolled out, aligned, held in place, and secured to the roof by, for example, nailing or stapling. It is also proven desirable to provide some type of filter or filter material in a vent to prevent insects, debris, and snow or moisture from being driven into the vent opening.

Accordingly, it is an object of the subject invention to provide a vent suitable for mounting over the vent opening in the ridge of a roof. It is another object of the invention to provide a vent that can be fastened in a roll for transportation and handling. A further object of the invention provides a vent including a filter member for resistance to insects, debris and moisture penetration.

SUMMARY OF THE INVENTION

In one embodiment of the invention, a roof vent is provided for use to cover a vent opening in the ridge of the roof including a base portion configured to extend generally longitudinally along the ridge of a roof; a plurality of vent extension members extending down from the base portion, the vent extension members forming vent passages to vent air exiting the vent opening and direct the air beneath and out of the sides of the vent, the vent extension members set at an angle to the longitudinal direction of the vent; and generally V-shaped filter members attached to the vent with the small end of the V adjacent the base portion. The V-shaped filter member has legs that spread when the vent is placed on a roof and provide temporary adherence of the vent to the roof until it can be permanently fastened.

The roof vent may also include a longitudinally extending channel which may have a concave configuration on the bottom of the base portion designed to face the roof.

Some of the vent extension members are set at an angle to other vent extension members forming a generally chevron configuration. The roof vent may further include additional vent extension members located at the ends of the base portion at an angle to the other vent extension members and being generally perpendicular to the longitudinal direction of the vent. The roof vent may further include at least one filter placement channel on each side of a midpoint of the vent and running longitudinally along the vent.

The roof vent may further include a plurality of sections attached to and overlapping at least a portion of one another, and the vent may be provided in a rolled length.

Another aspect of the invention is to provide a method for providing a roof vent to cover a vent opening in the ridge of a roof while maintaining ventilation through the vent opening including the steps of providing a base portion configured to extend generally longitudinally along the ridge of a roof; providing a plurality of vent extension members extending down from the base portion to form vent passages and provide a set off of the base portion from the roof, at least some of THE vent extension members set at an angle to a longitudinal direction of the vent; providing filter members attached to the vent to inhibit moisture and debris from entering the vent opening; and temporarily adhering the roof vent to the roof by attaching the filter members to shingles on the roof.

The filter members have a generally V-shaped configuration, and legs of the V-shaped filter members may extend beyond the vent extension members. The ends of the legs of the V-shaped filter members may extend parallel to the roof, to which they are adhered, and the point of the V is attached to the base portion.

The method may also provide a roof vent to cover a vent opening that may include the steps of providing the vent in sections, which are attached to one another in a partially overlapping fashion; providing the vent in a rolled form; unrolling the vent; and temporarily adhering the vent to the roof with the filter members, wherein the filter members have sufficient adherence strength to maintain the vent in an unrolled configuration until the vent is affixed to the roof with fasteners.

In another embodiment, a roof vent for use in covering a vent opening in the ridge of the roof has a plurality of sections with each section including a base portion configured to extend generally longitudinally along the ridge of a roof; a plurality of vent extension members extending down from the base portion, the vent extension members forming vent passages to vent air exiting the vent opening and direct the air beneath and out of the sides of the vent, the sections being attached to one another with ends of each section overlapping, and the vent is provided in a rolled configuration.

The roof vent may have filter members having a generally V-shaped configuration and are attached to the vent with a small end of the V adjacent the base portion. The roof vent may have extension members set at an angle to the longitudinal direction of the vent in a generally chevron configuration. The roof vent may further include a plurality of filter placement channels extending through the vent extension members for containing at least a portion of the filter members therein. The roof vent may further include a longitudinally extending channel with a concave configuration on the bottom of the base portion designed to face the roof and to facilitate bending the vent at an angle consistent with a pitch of the roof on which it is attached. The roof vent may further include a pair of bands, with one band being wrapped around all layers of the rolled configuration and a second band being wrapped around all layers but the outer layer.

The roof may include inner vent extension members and outer vent extension members, the inner vent extension members being located closer to a center line of the roof vent extending along the longitudinal direction thereof, the inner vent extension and the outer vent extensions being set at an angle to the midpoint line and further the inner vent extension members being set at an angle relative to the outer vent extension members, the outer vent extension members also being longitudinally offset from the inner vent extension members.

BRIEF DESCRIPTION OF THE DRAWINGS

The above-mentioned and other features and objects of this invention and the manner of obtaining them will become more apparent, and the invention itself will be better understood by reference to the following description of embodiments of the present invention taken in conjunction with the accompanying drawings, wherein.

Figure 1:
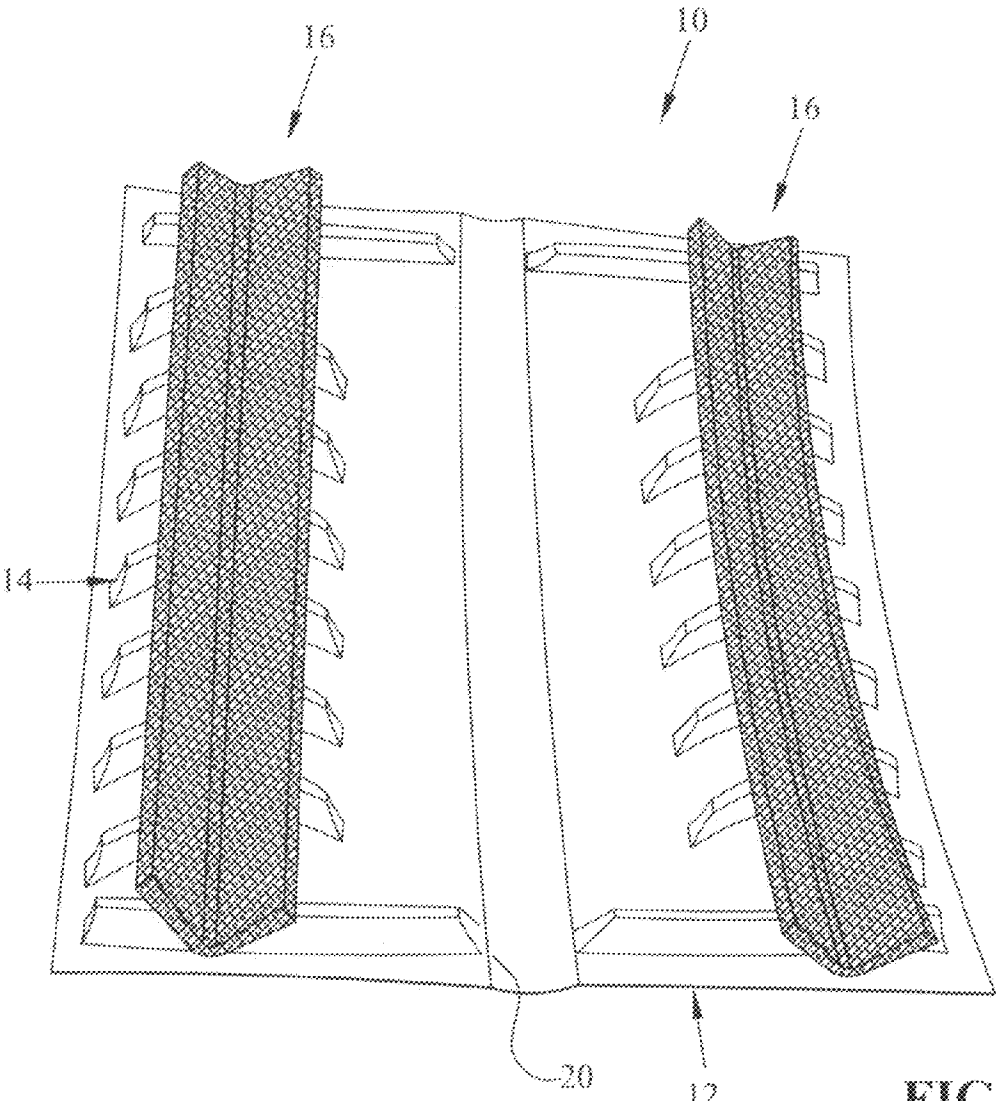
FIG. 1 is a bottom perspective view of one embodiment of a vent in accordance with the subject invention.

Corresponding reference characters indicate corresponding parts throughout the several views. Although the drawings represent embodiments of the present invention, the drawings are not necessarily to scale and certain features may be exaggerated in order to better illustrate and explain the present invention. The exemplification set out herein illustrates embodiments of the invention, and such exemplifications are not to be construed as limiting the scope of the invention in any manner.

DETAILED DESCRIPTION OF EMBODIMENTS OF THE INVENTION

For the purpose of promoting an understanding of the principles of the invention, reference will now be made to the embodiments illustrated in the drawings, which are described below. It will nevertheless be understood that no limitation of the scope of the invention is thereby intended. The invention includes any alterations and further modifications in the illustrated devices and described methods and further applications of the principles of the invention, which would normally occur to one skilled in the art to which the invention relates.

Now referring to FIGS. 1-10, a vent for venting an opening in the ridge of a roof is shown, generally indicated as 10. Vent 10 includes a base portion, generally indicated as 12, and a plurality of vent extension members, generally indicated as 14. Vent 10 also includes a pair of filter members, generally indicated as 16, and having legs 18. In the embodiment shown, vent 10, base portion 12 and vent extension members 14 are molded or thermo-formed as a one-piece body. In one embodiment, polypropylene is used, and pre- or post-recycled polypropylene can be used in any desired combination and percentage of the materials. Of course, other materials, such as other plastics, may be used.

As best shown in FIGS. 4 and 6-10, vent 10 includes a longitudinally extending channel 20, which is generally concave to the bottom portion of the vent that faces the roof. Channel 20 facilitates bending of base portion 12 about the opposite sides of the peak of a roof 40 so that vent extension members 14 are able to make contact with the roof.

Figure 8:
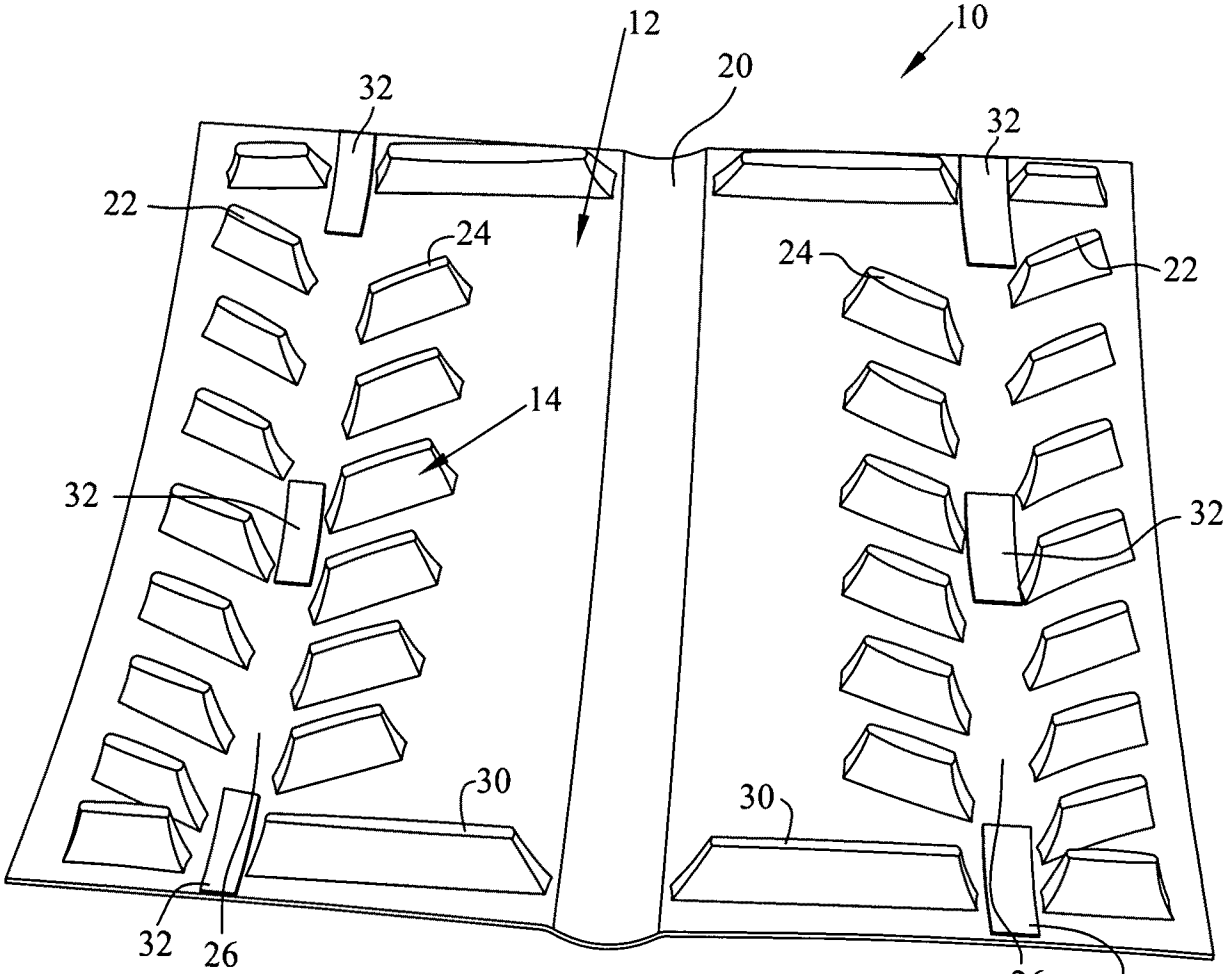
FIG. 8 is a bottom perspective view of the vent of FIG. 1 with the filter members removed.
Figure 9:
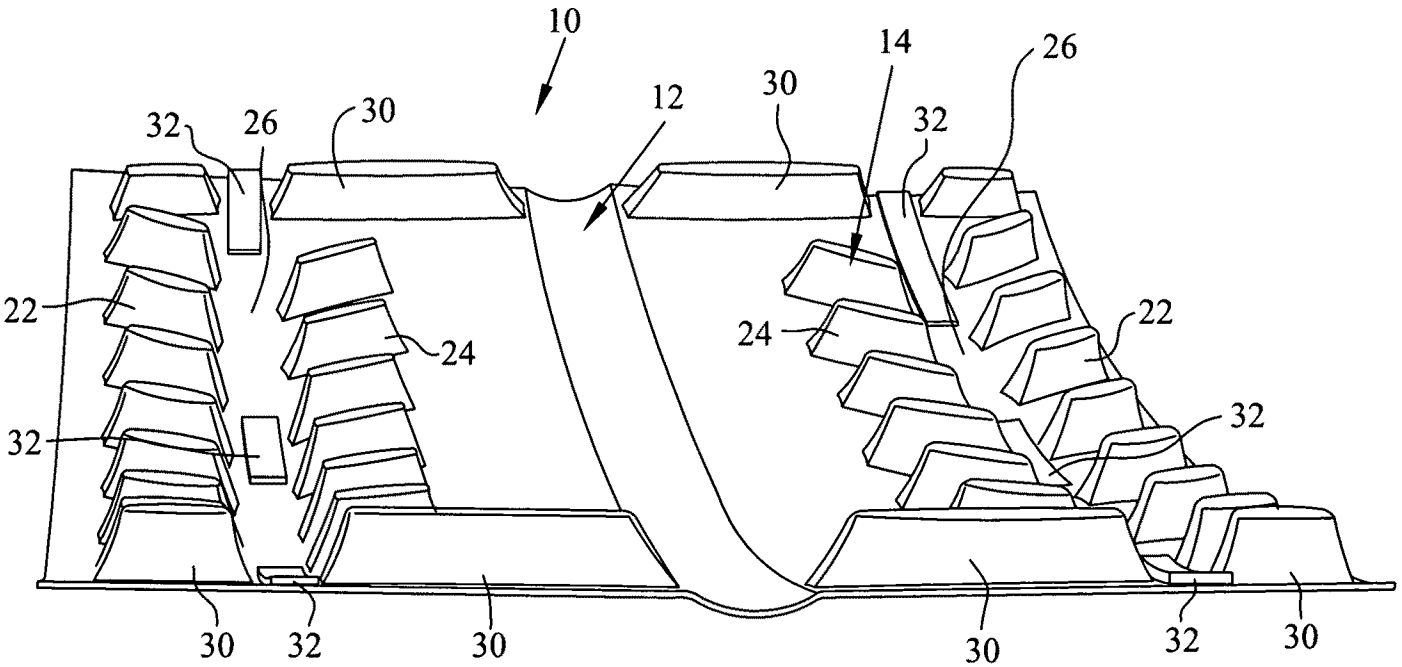
FIG. 9 is an end perspective view of the vent of FIG. 1 with the filter members removed.
Figure 10:
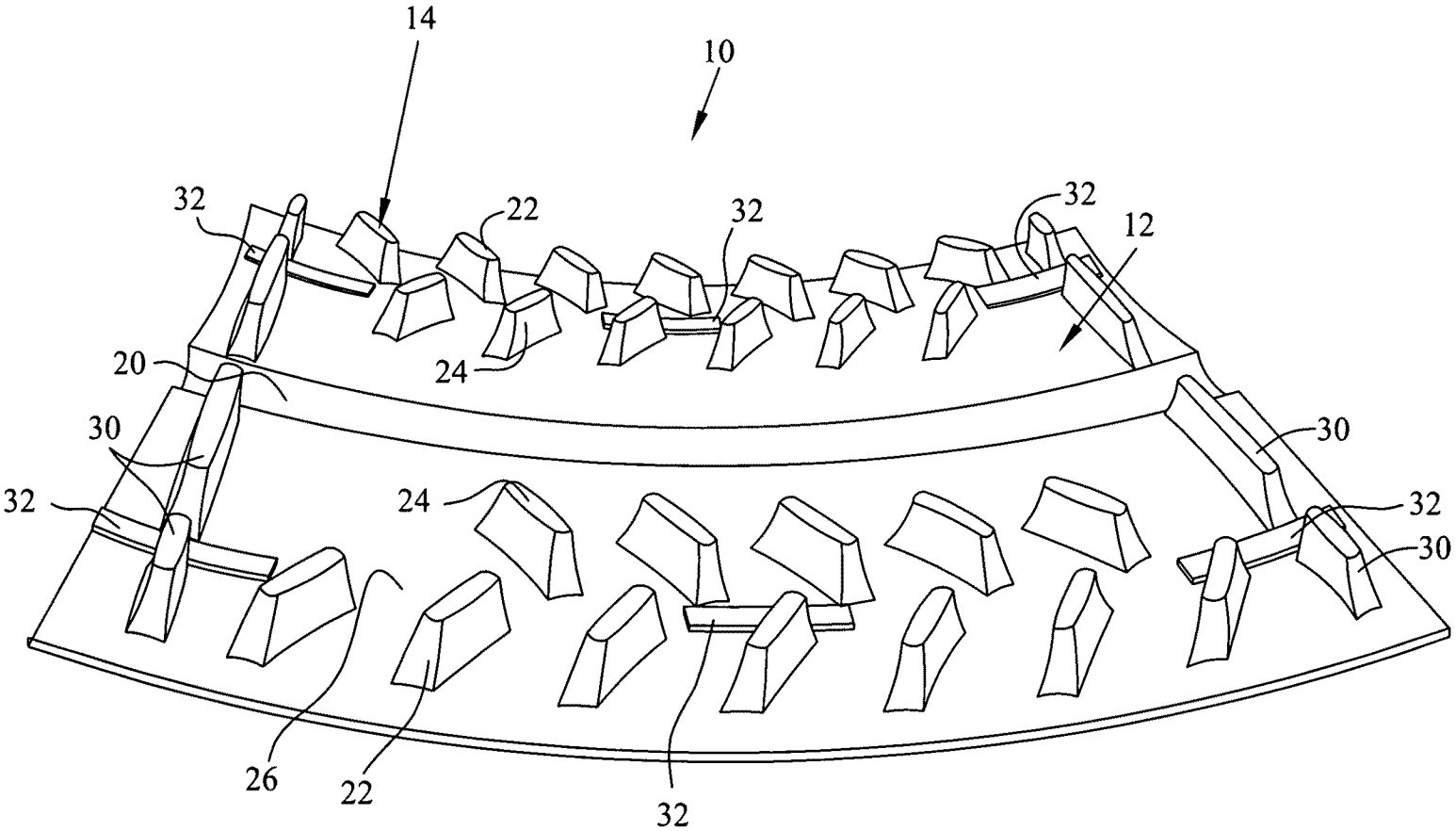
FIG. 10 is a side perspective view of the vent of FIG. 1 with the filter members removed.

In the embodiment shown, vent extension members 14 include two rows of extensions, outer extensions 22 and inner extensions 24 on each side of channel 20. Each row of outer extensions 22 and inner extensions 24 run generally parallel to the other extensions in the same row. Furthermore, outer extensions 22 and inner extensions 24 are set at an angle relative to one another in a generally herringbone or chevron configuration. Also, vent extension members 14 define vent passages 25, which allow air to vent from the ridge opening beneath vent 10 and out the sides thereof. A filter placement channel 26 is located between and defined by each row of outer and inner extensions, as best shown in FIGS. 8 and 9. In addition, each vent 10 includes end extensions 30 running generally perpendicular to the longitudinal direction of the vent and channel 20. End extensions 30 include openings or breaks in portions coinciding with channel 20 and filter placement channels 26.

In the embodiment shown, all of the extensions are pressed out of or thermo-formed from base channel 12 to form the unitary structure of vent 10.

In one embodiment, filter members 16 are formed from a polyester fiber-bonded material having a polyvinyl chloride binder. Filter members 16 may include 60 percent fiber and 40 percent binder in one embodiment. Filter material is preferably flame retardant, but may be heat sealable. In one embodiment, the filter members have a thickness of approximately 0.48 inches, however, other suitable thicknesses and materials may be used.

Figure 2:
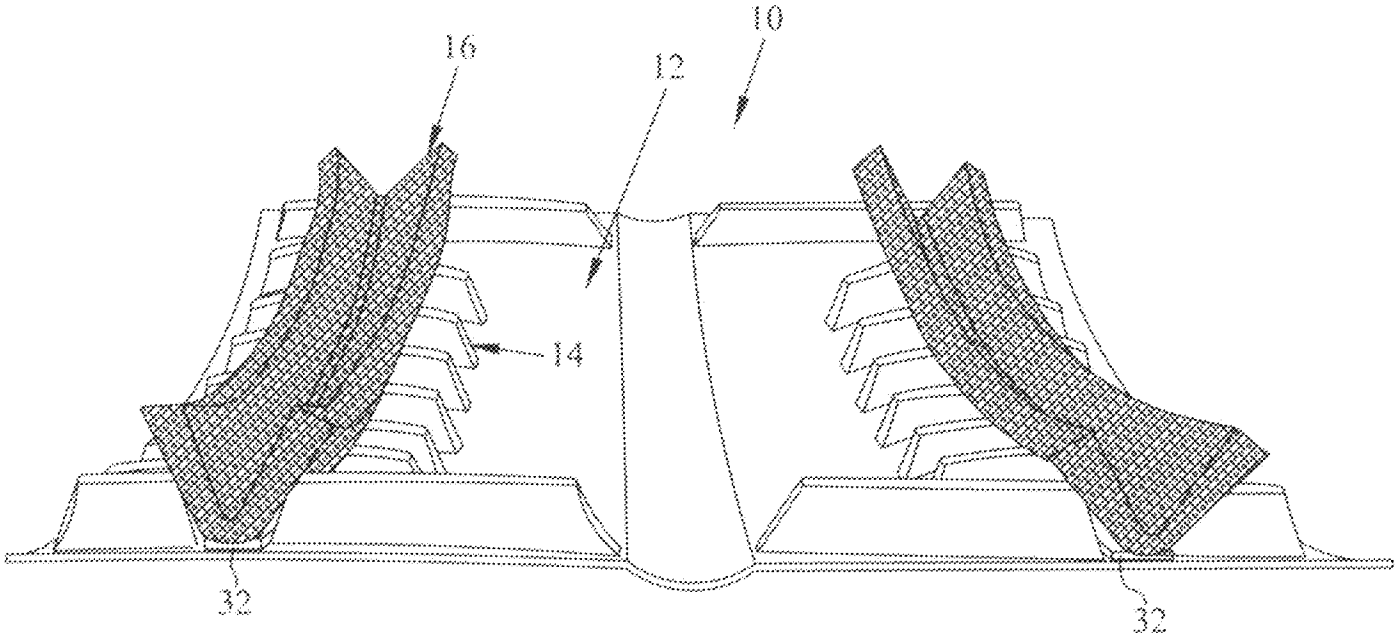
FIG. 2 is an end perspective view of the vent of FIG. 1.

In the embodiment shown, filter members 16 are bent in a generally V-shaped configuration and mounted to vent 10 with the narrow portion of the V located adjacent base portion 12 and in filter placement channels 26, as best shown in FIGS. 1 and 2. An adhesive, adhesive tape 32, or other known means may be used to attach filter members 16 to vent 10.

Figure 5:
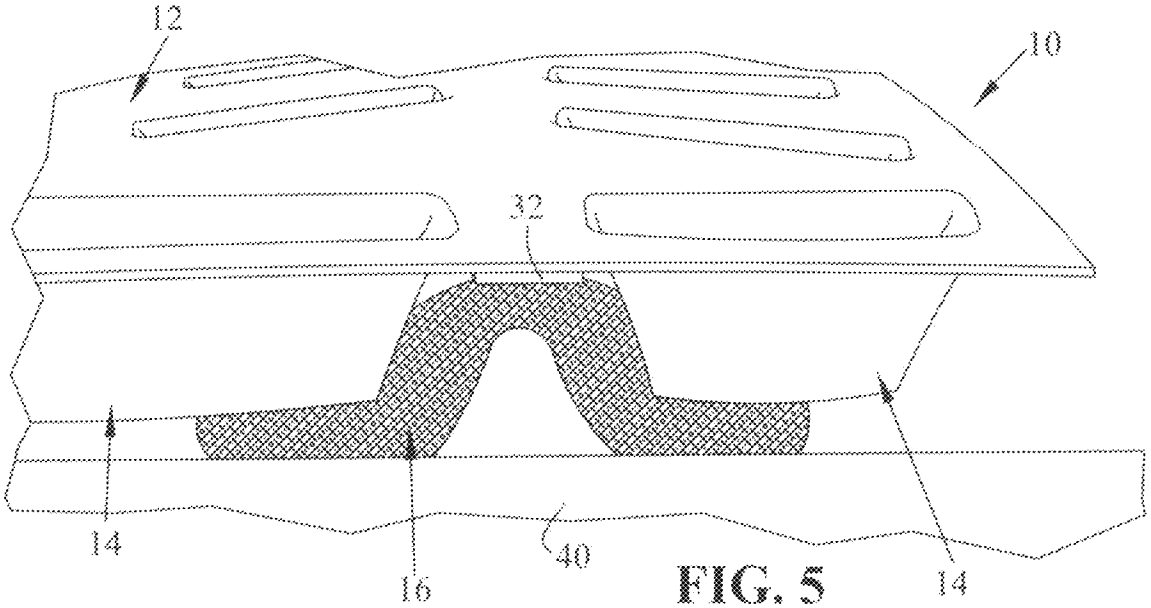
FIG. 5 is a close-up of a V-shaped filter member mounted in the vent of FIG. 1 and showing the filter in position for attachment to roof shingles.
Figure 6:
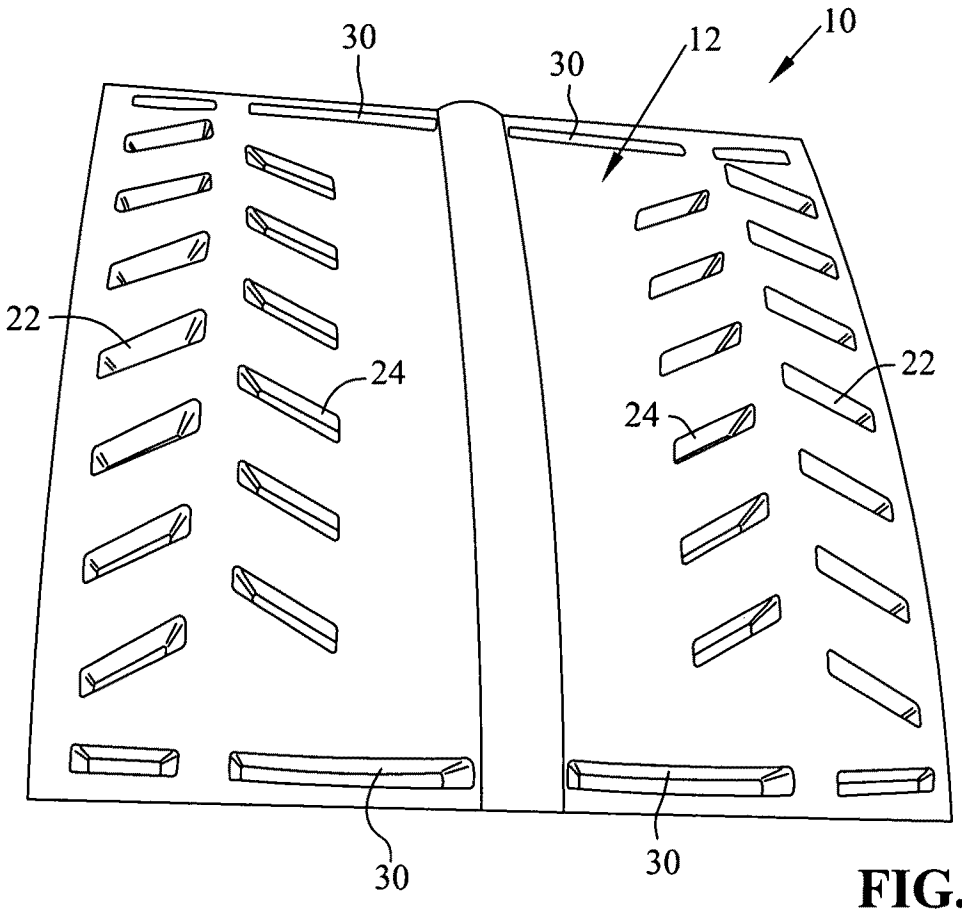
FIG. 6 is a perspective top view of the vent of FIG. 1.
Figure 7:
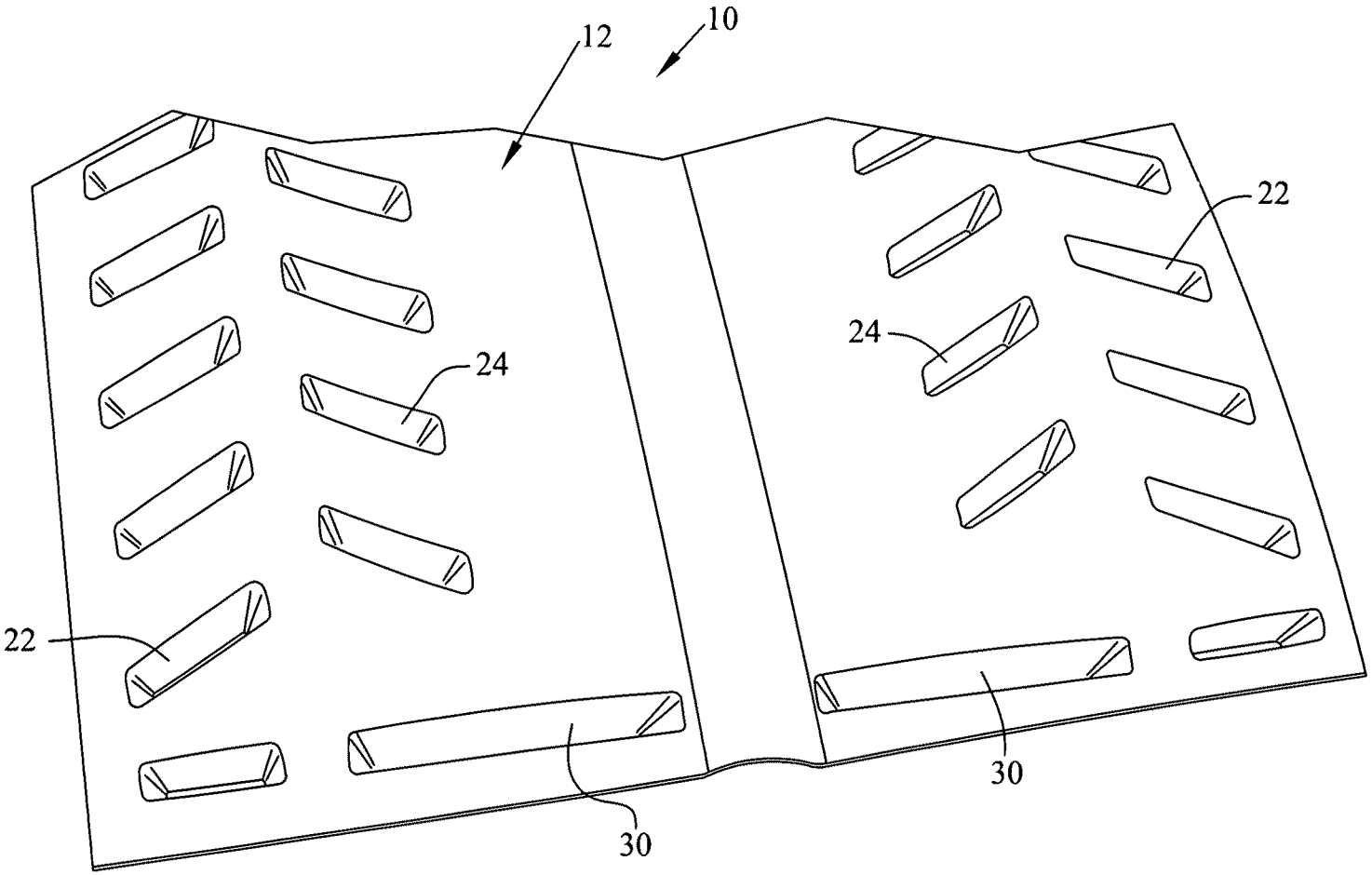
FIG. 7 is a close-up top perspective view of the vent of FIG. 1.

Now referring to FIG. 2, in this embodiment, the legs 18 of the filter members 16 extend below vent extension members 14. This facilitates spreading of the legs 18 of the filter members, as best shown in FIG. 5, when placed upon a roof so that ends of the legs are bent to be substantially parallel to the surface of roof 40. In addition to providing increased filtering and added resistance to penetration of moisture and other debris, this configuration facilitates adhering filter members 16 to the shingles on the roof that the vent is being attached to similar to the way that hook and loop fasteners function as it has been discovered that selecting an appropriate polyester fiber bonded material naturally grasps/adheres to the rough texture on the surface of shingles. Accordingly, this allows vent member 10 to be placed and held upon the roof prior to attaching thereto with nails or other fasteners.

Figure 3:
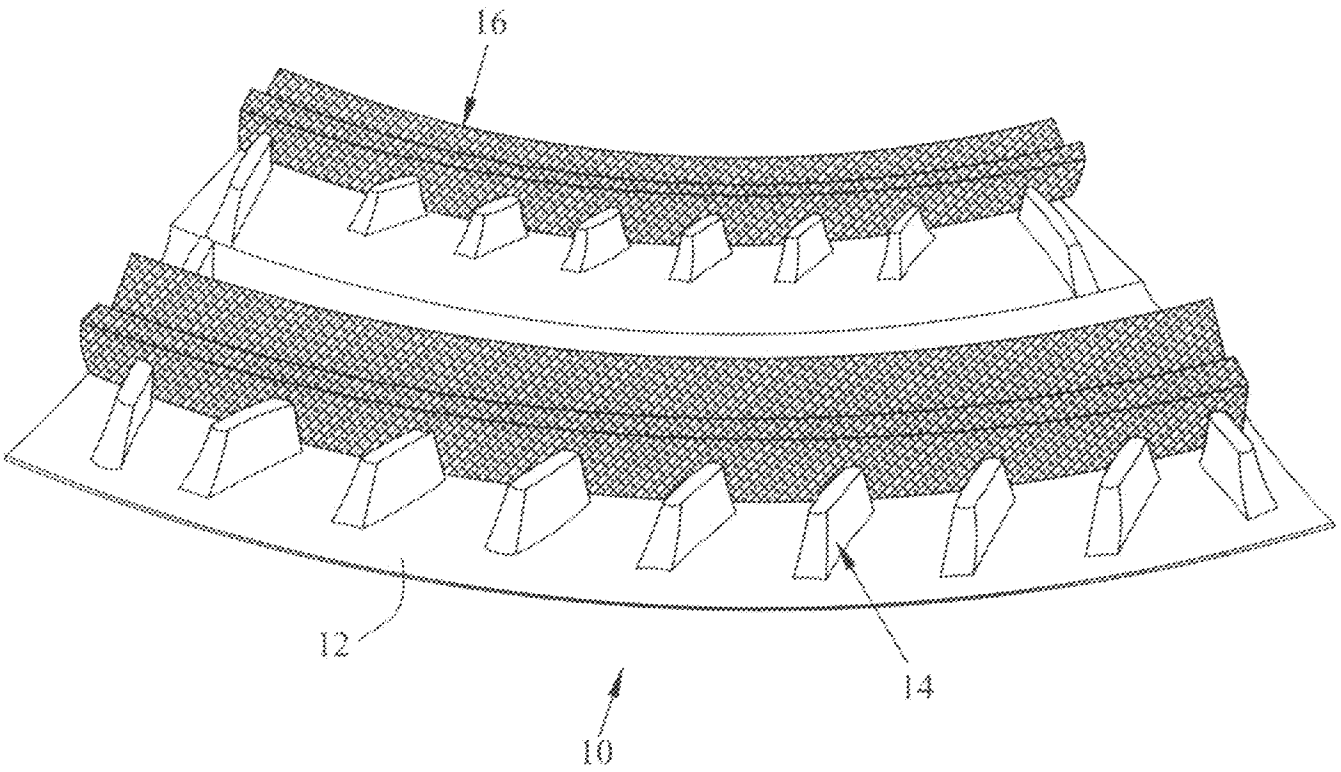
FIG. 3 is a side perspective view of the vent of FIG. 1.
Figure 4:
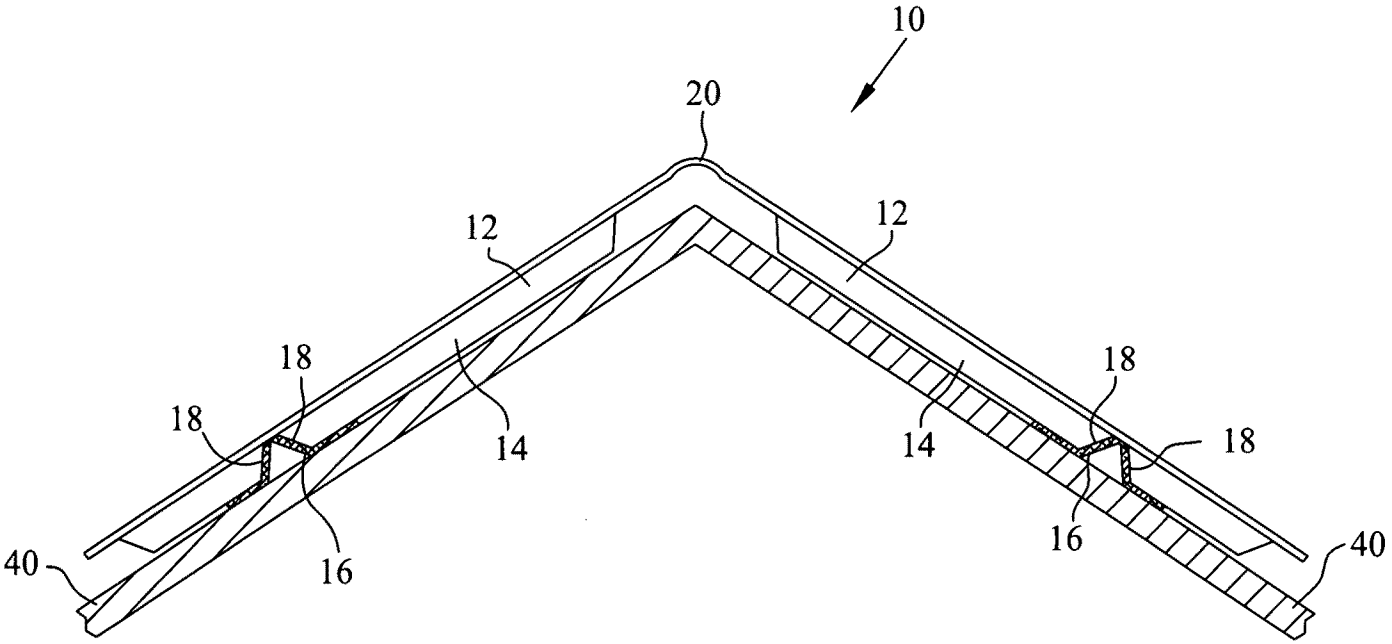
FIG. 4 is an end perspective view of the vent of FIG. 1 as would be mounted over a ridge vent.

Another advantage of the subject vent 10 is that the configuration lends itself to being made into a rolled configuration. As can be seen in FIGS. 2 and 3, the molded design produces a natural curvature in base 10 so that vent 10 can be rolled with the vent extension members 14 facing to the center of the roll. It should also be appreciated that such a rolled configuration facilitates ease in the storage, transportation and carrying of vent 10 to the roof. Furthermore, fasteners, bands, tape, or other binders, as shown and discussed in U.S. Pat. No. 6,039,646 to Sells, which is incorporated in its entirety herein by reference, may be used to facilitate holding vent 10 in a rolled configuration until ready for use and subsequently unrolling a portion thereof for attachment before releasing the remainder of the fasteners.

Figure 11:
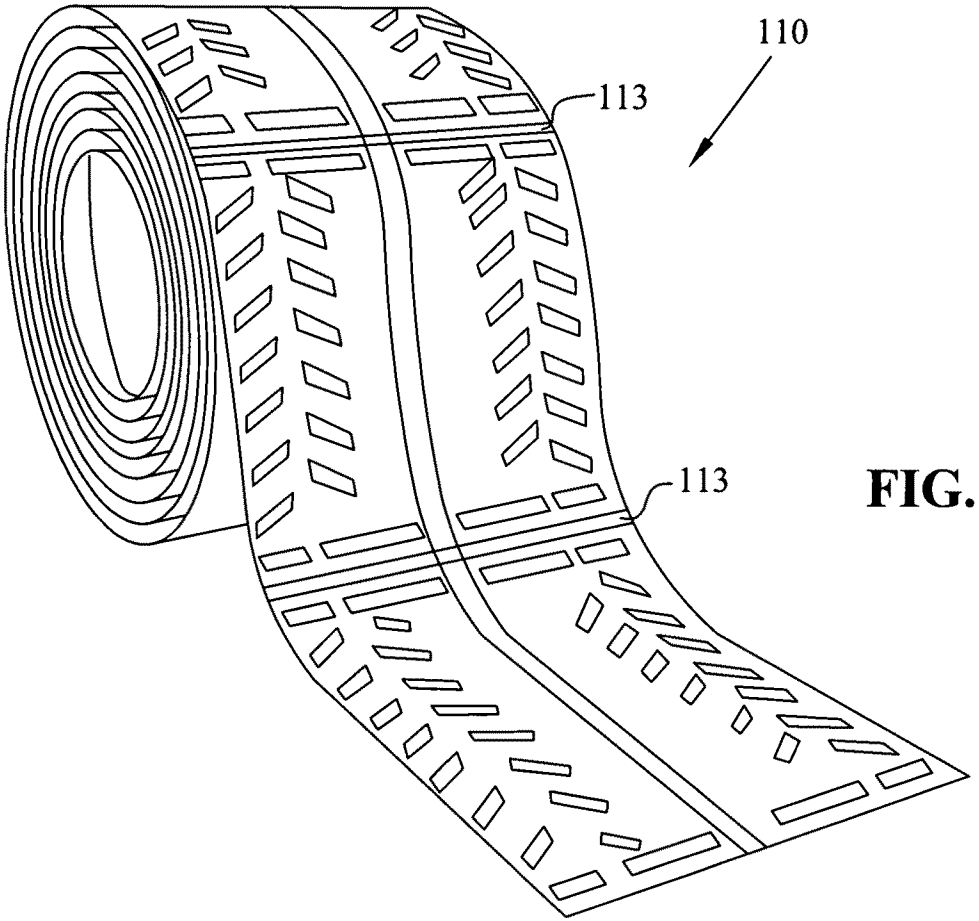
FIG. 11 is a perspective view of a vent in rolled form in accordance with the subject invention.

While the invention has been taught with specific reference to these embodiments, one skilled in the art will recognize that changes can be made in form and detail without departing from the spirit and scope of the invention. For example, the vent depicted may be made in an extended roll form as molded and in a singular piece, or alternately, shorter sections, such as shown, may be attached to one another, for example, using tape, an adhesive, or using a thermal bond or weld to make a longer rolled vent, generally indicated as 110, in FIG. 11 with overlapping end sections 113. The described embodiments are to be considered, therefore, in all respects only as illustrative and not restrictive. As such, the scope of the invention is indicated by the following claims rather than by the description.

The invention claimed is:

1. A roof vent for use to cover a vent opening in the ridge of the roof comprising:

a base portion configured to extend generally longitudinally along the ridge of a roof;

a plurality of vent extension members extending down from said base portion, said vent extension members forming vent passages to vent air exiting the vent opening and direct the air beneath and out of the sides of the vent, said vent extension members set at an angle to a longitudinal direction of the vent; and a pair of generally V-shaped filter members attached to said vent with the apex of the V adjacent said base portion, said V-shaped filter members including a pair of legs connected at said apex and extending beyond the ends of said vent extension members, said legs defining an open area therebetween, said open area extending along at least a portion of the length of and between said vent extension members, and one of each of said filter members is located on opposite sides of the vent opening in the ridge of the roof, wherein ends of said legs of said filter members bend when the vent is placed on a roof and provide temporary adherence of the vent to the roof until it can be permanently fastened, said legs being set at a first angle extending from said apex and a second angle extending from the bend.

2. The roof vent as set forth in claim 1, wherein said base portion includes a longitudinally extending channel.

3. The roof vent as set forth in claim 2, wherein said longitudinally extending channel has a concave configuration on the bottom of the base portion designed to face the roof and a convex configuration on an opposite side as provided before the base has been bent along a ridge of the roof.

4. The roof vent as set forth in claim 1, wherein some of said vent extension members are set at an angle to other vent extension members forming a generally chevron configuration.

5. The roof vent as set forth in claim 4, further including additional vent extension members located at the ends of said base portion at an angle to said other vent extension members and being generally perpendicular to the longitudinal direction of the vent.

6. The roof vent as set forth in claim 5, further including at least one filter placement channel on each side of a midpoint of the vent and running longitudinally along the vent.

7. The roof vent as set forth in claim 1, wherein said vent includes a plurality of sections attached to and overlapping at least a portion of one another, said vent being provided in a rolled length.

8. A method for providing a roof vent to cover a vent opening in the ridge of a roof while maintaining ventilation through the vent opening comprising the steps of:

providing a base portion to extend generally longitudinally along the ridge of a roof, said base portion being curved along a longitudinal length thereof;

providing a plurality of vent extension members extending down from said base portion to form vent passages and provide an offset of said base portion from the roof, at least some of said vent extension members set at an angle to a longitudinal direction of the vent;

providing filter members attached to the vent to inhibit moisture and debris from entering the vent opening, said filter members including legs extending downward beyond said extensions; and placing the vent down upon the roof and bending said legs of said filter members to temporarily adhere the roof vent to the roof by attaching said filter members to shingles on the roof, so that each of said legs extends at a first angle from said base and at a second angle where said legs are bent.

9. The method for providing a roof vent to cover a vent opening as set forth in claim 8, wherein said roof vent is supplied in a rolled configuration and said filter members have a generally V-shaped configuration, and further including the step of unrolling the roof vent along the ridge of a roof.

10. The method for providing a roof vent to cover a vent opening as set forth in claim 9, wherein legs of the V-shaped filter members extend beyond said vent extension members.

11. The method for providing a roof vent to cover a vent opening as set forth in claim 10, wherein a pair of filter member is provided and ends of all the legs of said V-shaped filter members are in contact with and extend parallel to an upper surface of the roof of which said ends of said legs are in contact and, to which they are adhered, and the point of the V is attached to said base portion, and one filter and both legs of each filter are positioned on opposite sides of the vent opening in the ridge of the roof.

12. The method for providing a roof vent to cover a vent opening as set forth in claim 8, including the steps of providing the vent in sections, which are attached to one another in a partially overlapping fashion; providing the vent in a rolled form; unrolling the vent; and temporarily adhering the vent to the roof with the filter members, wherein said filter members have sufficient adherence strength to maintain the vent in an unrolled configuration until the vent is affixed to the roof with mechanical fasteners.

13. A roof vent for use to cover a vent opening in the ridge of the roof comprising:

a plurality of sections with each section including a base portion configured to extend generally longitudinally along the ridge of a roof;

a plurality of vent extension members extending down from said base portion, said vent extension members forming vent passages to vent air exiting the vent opening and direct the air beneath and out of the sides of the vent, said sections being attached to one another with ends of each section overlapping, and provided in a rolled configuration, including a pair of filter members having a generally V-shaped configuration and attached to said vent with a small end of the V adjacent said base portion, and one of each of said filter members is located on opposite sides of the vent opening in the ridge of the roof, said V-Shaped filter members each including a pair of legs, an open area between said legs on each filter member, and said legs extending beyond said extensions and being generally straight before installation on a roof and bent and spread when installed on a roof, and wherein said extension members are set at an angle to the longitudinal direction of the vent in a generally chevron configuration; and a plurality of filter placement channels extending through said vent extension members for containing at least a portion of the filter members therein, and all of said legs extending parallel to an upper surface of the roof beyond where said legs are bent and along where said legs are in contact with the roof.

14. The roof vent as set forth in claim 13, further including a longitudinally extending channel with a concave configuration on the bottom of said base portion designed to face the roof and a convex configuration on an opposite side as provided in the rolled configuration before the base has been bent along the ridge of a roof, and to facilitate bending the vent at an angle consistent with a pitch of the roof on which it is attached.

15. The roof vent as set forth in claim 14, further including a pair of bands, with one band being wrapped around all layers of the rolled configuration and a second band being wrapped around all layers but the outer layer.

16. The roof vent as set forth in claim 13, including inner vent extension members and outer vent extension members, said inner vent extension members being located closer to a center line of the roof vent extending along the longitudinal direction thereof, said inner vent extension and said outer vent extensions being set at an angle to the midpoint line and further the inner vent extension members being set at an angle relative to the outer vent extension members, said outer vent extension members also being longitudinally offset from said inner vent extension members.

* * * * *